United States Patent [19]

Krämer

[11] Patent Number: 4,569,650

[45] Date of Patent: Feb. 11, 1986

[54] TABLET PRESS

[75] Inventor: Hans Krämer, Cologne, Fed. Rep. of Germany

[73] Assignee: Kilian & Co., GmbH, Cologne, Fed. Rep. of Germany

[21] Appl. No.: 696,179

[22] Filed: Jan. 29, 1985

[30] Foreign Application Priority Data

Feb. 7, 1984 [DE] Fed. Rep. of Germany ..... 3404108

[51] Int. Cl.[4] ..... B30B 11/08

[52] U.S. Cl. ..... 425/405 R; 425/225; 425/231; 425/353; 425/354

[58] Field of Search ..... 425/225, 226, 231, 352, 425/353, 354, 355, 405 R, 78, 107, DIG. 60, DIG. 116

[56] References Cited

U.S. PATENT DOCUMENTS

| | | | |
|---|---|---|---|
| 1,207,337 | 12/1916 | Stokes . | |
| 3,132,379 | 5/1964 | Crane | 425/78 |
| 3,332,367 | 7/1967 | Sperry et al. | 425/231 X |
| 3,784,343 | 1/1974 | Iwasaki | 425/352 |
| 3,999,922 | 12/1976 | Shimada | 425/353 X |
| 4,259,049 | 3/1981 | Willich | 425/353 X |
| 4,408,975 | 10/1983 | Hack | 425/231 |
| 4,475,880 | 10/1984 | Crossley et al. | 425/353 |

FOREIGN PATENT DOCUMENTS

| | | |
|---|---|---|
| 347438 | 1/1922 | Fed. Rep. of Germany . |
| 1552997 | 9/1969 | Fed. Rep. of Germany . |
| 2914201 | 12/1982 | Fed. Rep. of Germany . |
| 116572 | 12/1975 | German Democratic Rep. . |
| 479909 | 2/1938 | United Kingdom . |

*Primary Examiner*—J. Howard Flint, Jr.

*Attorney, Agent, or Firm*—Body, Vickers & Daniels

[57] ABSTRACT

A tablet press with a mould table and with multi-part rams whose movable ram parts slide along a stationary ram part having an internal hollow space connectable periodically to a suction device which removes, by suction mouldable material, dust which has penetrated in the interior of the movable ram, thus preventing the ram from being blocked with multiple material dust and making frequent cleaning and servicing of rams necessary.

9 Claims, 2 Drawing Figures

TABLET PRESS

Figures 1, 2:
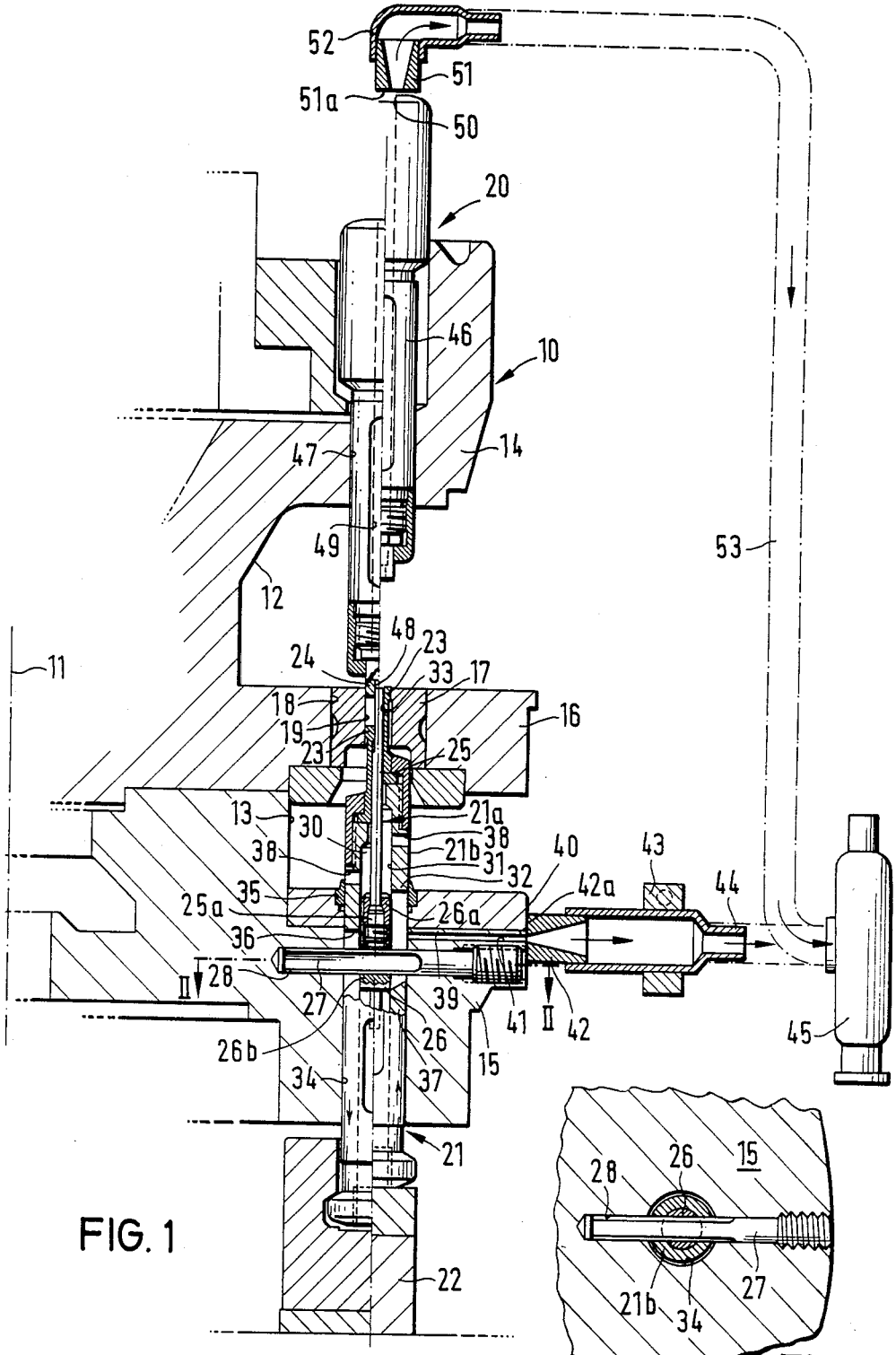

The invention relates to a tablet press with a mould table and with upper and lower rams which are associated with each mould and at least one of which comprises a plurality of inter-engaging parts which are movable axially relatively to one another, which engage in the mould bore, each ram having an axially arranged internal hollow space.

In tablet presses for the production of annular tablets or tablets provided with cutouts, multi-part rams are used which have a stationary ram part which always projects into the mould bore and also a movable ram part which is guided on the stationary ram part and co-operates with the counter-ram or opposite ram to mould the tablet in the mould bore, compress it, and eject at the end of the pressing operation. Since for strength reasons it is not possible to seal the movable ram part relatively to the mould bore and to the stationary ram part, the mouldable material in powder form can get in between the surfaces moving relatively to one another on the stationary ram part and the movable ram part and, respectively, on the opposite ram engaging over the stationary ram part, and the sliding surfaces become fouled with such powder, which settles in the internal hollow space in the ram, mixing at the same time with lubricant which is intended to facilitate the sliding movement of the ram parts moved rapidly relatively to one another in places where they are guided on one another. The mouldable material which has penetrated into the interior of the rams can lead very quickly to disturbances in operation and result in fracture of the rams unless these are cleaned in time. Hitherto, however, the cleaning of the rams has been a very time-consuming and involved operation, since each individual ram had to be demounted from the machine and dismantled in order to remove the mouldable material dust from the interior of the rams. This had the result that in hitheto known machines with multi-part press rams the down times for the machine i.e. the periods of time during which the machine had to be serviced and cleaned, and was therefore inactive, were longer than the production times.

The invention has as its object so to improve a tablet press of the kind initially specified that mouldable material dust which penetrates into the interior of the rams no longer hinders the functioning of the press, and it is no longer necessary to stop the machine to clean the press rams.

This object is achieved with this invention in that there is associated with the lower rams and/or the upper rams a suction device which can be connected to the internal hollow spaces of said rams and which aspirates away any mouldable material dust which has entered the interior of a ram.

This arrangement has the advantage that no mouldable material dust can accumulate in the interior of the press rams, and fouling of the ram sliding surfaces or blocking of the rams by encrusted particles of mouldable material cannot occur. Therefore, it is possible to operate the tablet press continuously.

The suction device advantageously comprises a suction nozzle which is so arranged in the press stand at a place at which at least one of the parts of the ram is distant from the mould that said nozzle is situated directly adjacent an outwardly leading aperture of the internal hollow space of the ram. As a result it is possible periodically to produce a negative pressure in the internal hollow space of the press ram, and suck-out mouldable material dust which has penetrated, in each case when the upper ram is outside of the mould and the lower ram is in its lowest position, before the mould bore is re-filled with mouldable material. In this way the negative pressure aspirates out only mouldable material dust which was already situated in the ram, but not material which is put into the mould and is to be moulded and compressed to tablet form.

The internal hollow space in the upper ram conveniently communicates through an axial bore in the ram shank with the aperture travelling past the suction nozzle, and, on entering the mould bore, engages over one of the parts of the lower ram. The suction nozzle can then be arranged immediately above the place at which the upper ram reaches its highest position, the suction nozzle being in alignment with the axial bore aperture leading into the free atmosphere. Such a construction is especially simple since it is simply necessary to have in the upper ram an axial bore which starts from the internal hollow space at the ram head which engages over the stationary ram part of the lower ram and enters the mould bore, to compress the mouldable material to tablet form. In its uppermost position the upper ram then enters the region of the suction nozzle, so that the mouldable material dust which may have entered the internal hollow space is aspirated away upwards through the axial bore in the ram.

In the lower ram the internal hollow space conveniently communicates through a perforation in the ram wall and through a transverse bore in the mould table with the aperture travelling past the suction nozzle. This arrangement ensures that a negative pressure can be produced in the internal hollow space in the lower ram at any time as soon as the aperture of the transverse bore arrives at the region of the suction nozzle for the lower ram.

It is especially advantageous to produce a controlled air flow in the internal hollow space of the lower ram as soon as said space is connected to the suction nozzle. For this purpose, the lower ram has below its head which penetrates into the mould bore, at least one air intake bore through which the internal hollow space in the lower ram communicates with the outside air. Advantageously a plurality of radial bores are provided through which outside air can enter the internal hollow space of the lower ram as soon as the suction nozzle is applied to the transverse bore. The air flow produced in the internal hollow space entrains dust particles which have entered the internal hollow space, and conducts them through the perforation and the transverse bore in the mould table into the suction nozzle, and from thence into the suction device where they are collected and separated out.

The lower ram can comprise a fixed pin which projects into the mould bore and which is secured in the mould table with a holder which extends through the perforation in the wall of the movable ram part, which at least partly surround the pin and is guided thereon and in the guide hole of the mould table. Such an arrangement gives the stationary part of the lower press ram a secure seating in the mould table, and ensures clean guidance of the movable ram part, so that precise pressing is possible. At the same time the wall perforation provided in the movable part allows unhindered upward and downward movement of the movable lower ram part and the removal of dust by suction from its internal hollow space.

The invention can be used in all tablet presses having multipart press rams, but it is of particular importance in rapid-movement rotary tablet presses wherein one or more mould bores are arranged in a circle on a rotating mould table, and in which a pair of rams comprising upper and lower rams is associated with each mould bore. In a tablet press with a movable mould table, which may be a longitudinally displaceable mould table with a plurality of mould bores arranged in a row one after the other, or a rotating mould disc, such as is usual in the aforementioned rotary tablet presses, it is often advantageous if the suction nozzle is substantially wider in the direction of movement of the mould table than the apertures which travel past it and which lead to the internal hollow spaces of the rams. Giving the suction nozzle an elongated form in the direction of movement of the mould table has the advantage that the suction effect exerted by the suction nozzle on the internal hollow space in each ram is maintained longer since each aperture of the axial bore or the transverse bore leading to the internal hollow space of each ram travels over a longer distance in the suction nozzle region.

Instead of a wide suction nozzle it is also possible to arrange a plurality of suction nozzles one after the other in the direction of movement of the mould table, the nozzles being connected to the suction device.

Further features and advantages of the invention are shown in the following description and the drawings, wherein a preferred constructional form of the invention is described in detail with the use of an example. In these drawings:

FIG. 1 shows a partial cross-section through the mould table of a rotary tablet press in the region of a mould bore, with upper ram and multi-part lower ram, the rams being shown in their compressing position in the left half and in their moved-apart position directly after the compressing operation in the right-hand half, and FIG. 2 shows a partial section through FIG. 1 on the line II—II.

In the drawings, lo designates the mould table of a rotary tablet press, which table is mounted in the machine stand not shown here to be rotatable about a vertical axis of rotation 11. The mould table 10 is divided by two large circumferential recesses 12 and 13 into an upper mould plate 14 and a lower mould plate 15, between which the mould platform 16 is situated. Arranged in the mould platform 16 is a plurality of moulds 17, in a circle, only one mould being shown in FIG. 1. Each mould 17 is arranged in a recess 18 provided for the purpose in the mould platform and is securely clamped in this recess in a manner not shown in detail here. Centrally the mould 17 is provided with a bore 19 into which the powderform mouldable material is introduced and is compressed by the press rams and compressed to form tablets.

Associated with each mould 17 is an upper ram 20 and a lower ram 21, whereof the upper ram 20 is mounted to be displaceable in the vertical direction in the upper mould plate 14 and the lower ram 21 in the lower mould plate 15. During rotation of the mould table lo the upper rams 20 slide on upper slide rails not shown in detail here, and the lower rams 21 along lower slide rails 22. The slide rails are so constructed that the upper rams 20 and the lower rams 21 move vertically towards and away from one another during the rotation of the mould table 10. With this, the upper ram 20 and the lower ram 21 can occupy the upper position shown in the right-hand half of FIG. 1, wherein the upper ram 20 is at its greatest distance from the mould, and the head 23 of the lower ram reaches the upper rim of the mould 17. In their lowest position the upper ram 20 and lower ram 21 are in the position shown in the left-hand side of FIG. 1, in which the head 23 of the lower ram 21 is in the lower portion of the mould bore 19, and the head 24 of the upper ram 20 enters the mould bore 19.

In the constructional example shown in the drawings the lower ram 21 comprises a fixed ram part **21*a* and a movable ram part 21*b* which is vertically displaceable relatively to the stattionary ram part 21*a*, upwardly and downwardly. The stationary ram part has a fixed pin 25 which projects concentrically into the mould bore 19 and is secured with its lower end 25*a* in a block 26. The block 26 is secured in the lower mould plate 15 of the mould table 10 with a holder 27 which is screwed into a radial bore 28 of the mould table 10 and extends through the block 26 of the pin 25. The block 26 is stepped and in its upper part 26*a* is somewhat thinner than in its lower part 26*b***.

The movable part **21*b* of the lower ram 21 has an internal hollow space 30 which extends in the axial direction and which is bounded on the one hand by the inner wall 31 of the lower ram shank 32 and on the other hand by the outer circumferential surface of the pin 25 and block 26 respectively. In the region of its head 23 the movable part 21*b* of the lower ram 21 has a bore 33 in which the pin 25 is arranged and with which the movable part 21*b* can slide along the pin 25 when the ram head 23 moves up and down in the mould bore 19. In a similar manner the cylindrical inner wall 31 of the movable ram part 21*b* abuts on the outer cylindrical surface of the block 26** and slides along the latter.

FIG. 1 shows that the lower ram 21 is mounted slidably in a vertical ram hole 34 of the lower mould plate 15, and at its outer periphery is sealed at the upper rim of the lower mould plate 15 with a rubber sleeve 35. Furthermore the movable part **21*b* of the lower ram 21 has, in the region of its lower shank, a perforation 36 in the ram wall, which perforation has the holder 27 of the stationary ram part 21*a* extending through it and which is sufficiently large to ensure that the movable part 21*b* of the lower ram 21 can move up and down unhindered in the region of the holder 27**.

As FIG. 1 shows, the internal hollow space 30 of the lower ram 21 communicates with the outside air through two radially disposed air intake bores 38. Situated in the lower mould plate 15 of the mould table 10 is a radially arranged transverse bore 39 opening into the ram hole 34 in the region of the perforation 36 of the movable ram part **21*b* and having a mouth or aperture 41 at the outer circumferential wall 40 of the lower mould plate 15. When the mould table 10 rotates, this aperture 41 of the transverse bore 39 travels past a suction nozzle 42 which with a holder 43 is secured in the machine stand at the height of theaperture 41, at a place at which the lower ram 21 is situated immediately before the filling station in which the powdered mouldable material is introduced into the mould bore 19 and in which the head 23 of the movable part 21*b* of the lower ram 21 is in its lowest position, which is shown in FIG. 1 in the left-hand half of the drawing. The suction nozzle 42 is connected by way of a flexible tube 44 or another suction conduit to a suction device 45, for example a vacuum vessel or an apparatus for producing a negative pressure, which has a collecting container for material in dust form. This suction device 45 produces in the suction conduit 44 and in the suction nozzle 42 a continually effective negative pressure which acts through the transverse bore 39 and the perforation 36 inside the internal hollow space 30 of the lower ram 21 each time the aperture 41 aligns with the suction nozzle 42, whose mouthpiece 42***a* is situated immediately adjacent the outer peripheral edge 40 of the lower mould plate 15.

Turning now to the upper ram 20 it will be seen that the shank 46 of this ram is guided to be vertically slideable in a ram hole 47 of the upper mould plate 14, and this ram has in its head 24 an internal hollow space 48 the diameter of which is adapted to the diameter of the central pin 25. On penetration into the mould bore 19 the head 24 with its internal hollow space 48 engages over the head of the central pin 25, so that the mouldable material situated in the annular chamber between mould bore and central pin is pressed downwards against the head 23 of the movable part 21*b* of the lower ram 21 and an annular tablet is formed.

The internal hollow space 48 of the head 24 of the upper ram 20 is followed by an axial bore 49 which with an aperture 50 arranged at the upper shank end leads towards the exterior.

When the upper ram 20 is in its highest position, which is shown in FIG. 1 at the right-hand side and which is reached when the associated mould bore 19 is situated directly before the filling station wherein said bore is filled with mouldable material, the aperture 50 of the axial bore 49 travels past a suction nozzle 51, which is securely arranged with a holder 52 in the machine stand. Like the suction nozzle 42, the suction nozzle 51 is connected with a suction conduit 53 to the suction device 45, and removes by suction through the axial bore 49 any mouldable material dust which may have penetrated into the internal hollow space 48 of the upper ram 20 each time the aperture 25 of the upper ram travels past its mouth 51*a*. In order to have sufficient time available for aspirating mouldable material dust from the internal hollow space 48, a plurality of suction nozzles 51 are arranged directly one behind the other (approximately at right angles to the drawing plane in FIG. 1) in the circumferentialdirection of the mould table 10 in which the upper rams 20 move, although only one of these suction nozzles 51 can be seen in FIG. 1. The suction nozzle 42 for aspirating mouldable material dust out of the internal hollow space 30 of the lower ram 21 has a nozzle opening which is elongated in the circumferential direction of the mould table, this opening being substantially wider than the aperture 41 travelling past it belonging to the transverse bore 39, which leads to the internal hollow space 30.

The method of operation is as follows:

When the mouldable material powder is introduced into the mould bore 19 and the annular tablets are then pressed, material dust can get into the internal hollow space 30 between the outer surface of the stationary pin 25 and the central bore 33 in the movable part 21*b* of the lower ram 21. At the same time when the upper ram 20 plunges-in, small quantities of mouldable material dust may enter the internal hollow space 48 of the upper ram 20.

Then, as soon as the mould table lo as it rotates arrives immediately before the filling station, and the lower ram 21 has reached its lowest position shown at the left in FIG. 1, and the upper ram 2o has reached its highest position in FIG. 1, the aperture 41 of the transverse bore 39 travels past the suction nozzle 42 and the aperture 50 of the axial bore 49 travels past the suction nozzle 51. As a result the internal hollow space 30 of the lower ram 21 and the internal hollow space 48 of the upper ram 20 are connected to the suction device 45, and in both spaces an air flow is produced, outside air being aspirated through the internal hollow space in the case of the lower ram by way of the air intake apertures 38 and in the case of the upper ram directly through the downwardly open internal hollow space 48. The throughflowing air entrains infiltrated dust and conveys it through the axial bore 49 in the one case and the perforation 36 and transverse bore 39 in the other case into the suction nozzles 51 and 42 respectively and from there through the suction conduits 53 and 44 into the suction device 45, where the dust is separated out.

The invention is not limited to the constructional form which has been described and illustrated, and instead a number of modifications and additions may be made thereto without departing from the scope of the invention. For example the stationary ram part may also be arranged in the vicinity of the inner wall of the mould bore 19, and may be given a different form, for example a triangular cross-section. It is also possible to construct the upper ram in two parts, and to form the internal hollow space somewhat differently. The suction nozzles may also be arranged at other places on the path of rotary travel of the mould table, and it is also possible to use the invention in tablet presses of another kind, for example in tablet presses which have only a single mould with an upper ram and lower ram, or a plurality of moulds which are arranged one after the other in a straight row and which are moved to and fro between a pair of rams.

Having thus described the invention, it is claimed:

1. A tablet press having a press stand, which supports a mould table having a mould bore supported thereon, and upper and lower generally axially reciprocating rams, said rams each associated with a mould, wherein at least one of said rams comprises a plurality of interengaging parts movable axially relative to one another, engaging said mould bore, each said ram having an axially disposed internal hollow space therein, said tablet press further comprising a suction device associated with at least one of said lower rams and said upper rams adapted to be connected to said internal hollow space thereof, said suction device removing by suction mouldable material dust which has entered said interior hollow spaces of said rams.

2. A tablet press as defined in claim 1, wherein said suction device comprises a suction nozzle adapted to communicate with an outwardly leading aperture formed in each said ram and leading from said internal hollow space, said suction device arranged on said press stand in a position such that during the axially action of one of said rams said ram is removed from mould, such that said nozzle is directed adjacent said outwardly leading aperture of said internal hollow space of said ram.

3. A tablet press as defined in claim 2, wherein said hollow space in said upper ram communicates through an axial bore provided on a ram shank on said upper ram with said upwardly leading aperture as the ram shank reciprocates past said suction nozzle and, when the mould bore is entered, said internal hollow spaces engages over one of said interengaging parts of said lower ram.

4. A tablet press as defined in claim 3, wherein said suction nozzle is aligned with said outwardly leading aperture of said axial bore, leading into the outside air immediately above the place at which said upper ram reaches in its highest reciprocating position.

5. A tablet press as defined in claim 2 wherein said internal hollow space in said lower ram communicates through a perforation in the ram wall and through a transverse bore in said mould tablet with said aperture traveling past the suction nozzle.

6. A tablet press as defined in claim 1 wherein said lower ram has a head penetrating into the mould bore and including at least one air intake bore through which said internal hollow space of said lower ram communicates with said outside air.

7. A tablet press as defined in claim 5 wherein said lower ram has a fixed pin projecting into said mould bore, said pin secured in the mould table with a holder which extends through said perforation in a wall of said lower ram, said ram at least partially surrounding and guided by said pin and in the ram hole of said mould table.

8. The tablet press as defined by claim 2, and wherein said mould table moves in relation to the suction nozzle, said suction nozzle being substantially wider in the direction of movement of the mould table and the outwardly leading aperture of the ram which travels past said suction nozzle and leads to the internal hollow space of the ram.

9. A tablet press as defined by claim 1 wherein said mould table is movable in relationship to said rams and further comprises a plurality of suction nozzles connected to said suction device and arranged one after the other in the direction of movement of the mould table.

* * * * *